US005769200A

United States Patent [19]

Meyer et al.

[11] Patent Number: 5,769,200

[45] Date of Patent: Jun. 23, 1998

[54] COIN COLLECTION APPARATUS

[75] Inventors: Wilfried Meyer, Buxtehude; Hans-Ulrich Cohrs, Horneburg, both of Germany

[73] Assignee: National Rejectors, Inc., GmbH, Buxtehude, Germany

[21] Appl. No.: 693,880

[22] Filed: Aug. 5, 1996

[30] Foreign Application Priority Data

Aug. 9, 1995 [DE] Germany ..... 195 29 259.6

[51] Int. Cl.[6] ..... G07F 1/00

[52] U.S. Cl. ..... 194/203; 194/346

[58] Field of Search ..... 194/203, 346, 194/348

[56] References Cited

U.S. PATENT DOCUMENTS

| | | | |
|---|---|---|---|
| 4,298,116 | 11/1981 | Niemeyer | 194/203 |
| 5,145,046 | 9/1992 | Satoh | 194/203 |
| 5,485,906 | 1/1996 | Newton et al. | 194/203 |
| 5,496,212 | 3/1996 | Meyer-Weingartner et al. | 194/346 X |

FOREIGN PATENT DOCUMENTS

| | | |
|---|---|---|
| 0 622 763 B1 | 11/1994 | European Pat. Off. . |
| 0 628 930 A1 | 12/1994 | European Pat. Off. . |
| 2 213 375 | 10/1973 | Germany . |
| 2 326 343 | 12/1974 | Germany . |
| 25 55 213 B2 | 10/1977 | Germany . |
| 39 29 749 A1 | 4/1990 | Germany . |
| 41 17 096 C1 | 8/1992 | Germany . |
| 42 31 534 A1 | 10/1993 | Germany . |
| PCT/US85/01327 | 1/1987 | WIPO . |

*Primary Examiner*—F. J. Bartuska

*Attorney, Agent, or Firm*—Senniger, Powers, Leavitt & Roedel

[57] ABSTRACT

A coin collection apparatus for use with a coin validity testing device. The apparatus includes an electromagnetically actuated accept flap located downstream of the testing device which accept flap is pivotally supported to rotate about a horizontal axis to direct coins to a reject channel or an accept channel in response to signals delivered by the testing device. The accept flap is biased by a spring to the reject position. The apparatus further includes a first sensor located downstream of the accept flap and a second sensor located downstream of the first sensor and a processor to which the signals of the testing device and the sensors are supplied. The upper portion of the accept flap engages the wall of the coin channel in the reject position cooperates therewith such that a string to which a coin is attached will be retarded or clamped and the processor will calculate the passing time of the coin based on the timing occurrence of the sensor signals of the sensors to generate a warning signal if the passing time exceeds a predetermined value. An optical string detection device is also disclosed.

18 Claims, 4 Drawing Sheets

COIN COLLECTION APPARATUS

This invention relates to a coin collection apparatus in which a coin is deposited for the purchase of services or supplies from a vending device, for example.

BACKGROUND OF THE INVENTION

One of the possibilities of fraudulently operating a coin operated device is to guide a genuine coin through a coin testing device while being attached to a relatively thin string. As one uses a genuine coin and as the passing time conforms to that of genuine coins, the coin will be verified by the coin testing sensors and will be automatically supplied to an accept location. This will be controlled by an accept gate operating to direct genuine coins to an accept channel and false coins to a return channel. A sensor is typically provided downstream of the accept gate to generate a credit signal to deliver the desired goods or service. Since, however, the coin is attached to a string it will not enter the cash box. Rather, the operator tries to pull the coin back either to the coin slot or to a point above the accept gate and from there into the reject channel. According to a similar manipulation a counterfeit coin or a washer is attached to the second end of the string to be inserted after the genuine coin has been accepted. The second coin of course travels into the reject channel. Thereafter, the operator tries to remove the genuine coin this way by using the second coin.

It is known to have the string with the coin attached thereto actuate a lever which is prevented from returning to its original position. This position is optically monitored as to delivering a signal to a control and processing circuit. Methods of this type are disclosed in German 39 29 749, European 0 358 956 and German 41 17 096. However, the string must be relatively stiff and subjected to some tensional force in order to actuate the lever and trigger the signal.

PCT Patent Application No. WO 87/00663 discloses a coin testing device including a slot which is located at the end of a coin chute downstream of the testing sensors between the track and the chute wall. The string becomes trapped in the slot when an attempt is made to withdraw the coin. The coin track prevents the action of pulling back the coin so that either the string ruptures or is released. In both cases the coin enters the cash box. Accordingly, a credit signal will be generated and the goods or service delivered. Since a genuine coin has been inserted, this operation is not harmful. The same reference teaches to monitor the coin or the travelling direction of the coin in order to determine whether or not a coin being attached to a string passes or has been pulled back and whether or not a conventional coin travels along inside the coin testing device.

Devices of similar type referring to pulling back a coin attached to a string are disclosed in German patent applications Serial Nos. 22 13 375, 25 55 213 and 23 26 343.

European 0 628 930 further discloses providing a retaining slot between a false coin track below a genuine coin track and the wall as well as a sensor in addition to the presence sensor for generating a credit signal in order to monitor the travelling direction of a coin. In case a coin is pulled back the sequence of the presence signals will be reversed and an alarm signal will be generated.

If the appliances for preventing pulling back a coin are designed to be sufficiently rugged as described for example in European 0 628 930, there is some likelihood that a service operation will not be required. It should be understood that servicing should be kept to a minimum to reduce costs. Accordingly, the coin withdrawal prevention means should not result in blocking of the apparatus.

In addition to coin withdrawal prevention it is desired to produce a signal indicating fraudulent string manipulation indicating to the servicing personnel that there has been a manipulation. Furthermore, the signal may be used to stop the delivery of goods even if the sensors have determined a genuine coin.

Accordingly, it is an object of the present invention to provide a coin collection apparatus which safely determines the presence of a string even when the string is relatively thin and loose.

SUMMARY OF THE INVENTION

German Patent Application No. 195 29 259.6 filed Aug. 9, 1995 is incorporated herein by reference.

The present invention makes use of an accept gate which in the preferred embodiment is shaped as a flap directing an entering coin either to a reject channel or an accept channel. The flap is normally biased by a spring towards the reject position and will be pivoted to the accept position by means of a solenoid when the testing unit transmits a signal associated with a genuine coin. As soon as the coin has passed the accept gate the latter will be readjusted to the reject position. This can be performed by means of a sensor located downstream of the accept gate which generates a credit signal when the coin passes the sensor. The apparatus according to the invention automatically provides for squeezing the string in the accept gate in the blocking position thereof such that the coin having passed through the gate is stopped or slowed down. In order to stop or slow down the coin, the engaging surface of the accept flap and the chute wall provide increased friction, for example, by roughening or by selecting a material having a high frictional coefficient. According to an alternative embodiment of the invention, the accept flap may have at least a side projection engaging a recess provided in the wall. The clamping area of the accept flap may be provided with teeth which can intermesh with corresponding teeth in the wall. The string will then change direction and will be jammed and either be stopped, or slowed down to an extent that the coin will travel with a much slower speed than normal. The time period the coin needs for passing the distance between a pair of spaced apart sensors downstream of the accept gate may be determined. For a regular speed and a usual distance between the sensors, there will be a time window of about 60 to 80 ms. As already referred to, the string attached to a relatively lightweight coin can be stopped so that the coin passes the first sensor, but comes to a stop between both sensors or continuously activates the second sensor. Heavyweight coins are subjected to the delay referred to so that time periods of longer than 100 ms may result.

An additional sensor may be included for determining a false position of the flap. A thicker string will not allow the flap to completely return to the original position. The sensor will determine if the flap has not returned to its original position and transmit a signal to reduce the possibility of a fraudulent transaction.

European 0 622 763 shows a pair of spaced apart sensors. The signals delivered therefrom, however, are used to check the order of occurrence, not to perform a speed or time sensing function.

According to the preferred embodiment of the invention described above, the presence of a string is indirectly determined by measuring the travel time of a coin between two locations. In another embodiment of the invention a string is sensed by optical means. The shadow cast by a string extending through an optical measuring field of view covering the full width of the coin chute is too small to detect. However, it is not possible to limit the field of view to a small area of the coin chute since the string may be located anywhere along the width of the chute, particularly if the string becomes slack. Thus, the invention provides for an optical channel which is defined by recesses in a flap cooperating with the adjacent wall which is engaged by the flap in its blocking position. In the release position the flap provides for a free passing of the coin. While moving the flap towards the blocking position, which is initiated by a sensor or by a time delay means automatically adjusting the flap from the passing position into the blocking position after a predetermined time period ends, a string will be urged towards the adjacent wall. The string thus automatically enters the optical channel. The cross-sectional area of the optical channel may be selected to be relatively small so that the difference of the signal provided by the optical sensing means when a string is present is higher than 15%. This difference is easy to detect. Therefore, should a significant shadowing of the optical sensing means arise, a warning signal may be initiated.

The flap may be arranged as a separate member in the coin collection apparatus. For example, the flap may be arranged in the inserting slot of the coin testing device. Accordingly, the flap will be directly actuated by the coin. This provides the advantage that a coin attached to a string may be sensed at an early time and directly fall into the reject channel and not enter the accept location. According to the invention the flap can be defined by the accept gate which is already present in a coin collection device.

When the coin is suspended by wire or a stiff string, the flap may not completely close and the amount of light will be even higher than it would be when no string is present. To avoid a false indication, a lug is attached to the flap and engages an aperture or recess provided in the channel wall when the flap contacts the channel wall or has a small distance therefrom, the lug having an aperture which faces towards the optical channel. The lug covers the receiver of the optical sensing means even when the flap is slightly open so that the amount of light received will be reduced.

BRIEF DESCRIPTION OF THE DRAWINGS

Embodiments of the drawings will now be described by way of example with reference to the accompanying drawings of which

DETAILED DESCRIPTION OF THE EMBODIMENTS

Figure 1:
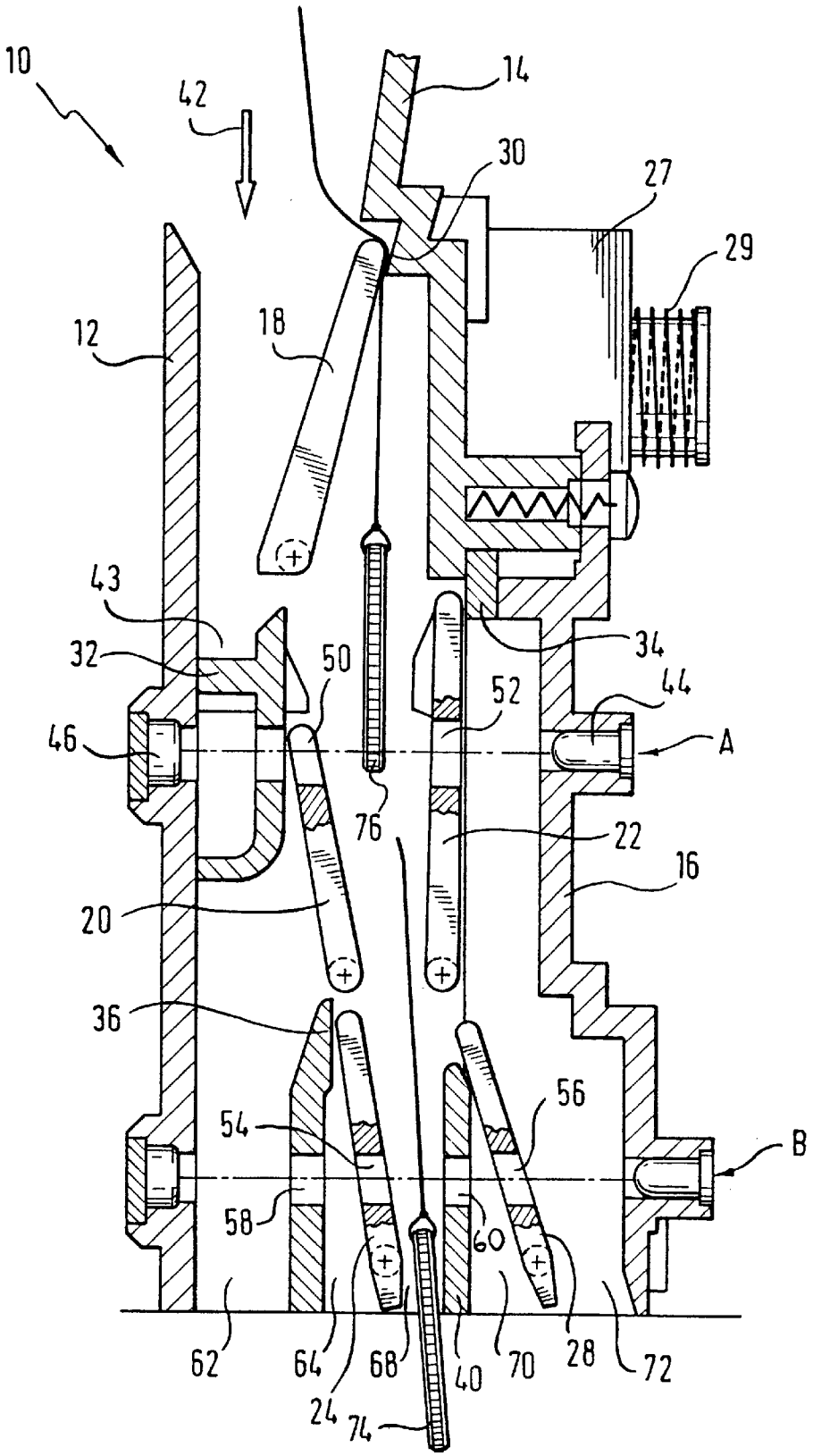
FIG. 1 is a schematic sectional view of a classifying device for a coin operated device including an apparatus of a first embodiment of the present invention.

FIG. 1 shows a classifying device 10 comprising a pair of parallel plates 12 and 14 as well as a third plate 16 depending from plate 14, between which plates a number of flaps 18, 20, 22, 24, 28 are pivotally supported. The pivoting motion takes place about an axis extending perpendicularly to the plane of the drawings. The flaps 18 through 28 are actuated by solenoids, one of which is shown at 27 for actuating flap 18. The solenoid plunger is biased by a spring 29. The flaps 24 and 28 are adjusted by a single solenoid. The flaps 18 through 28 are shown to be in a rest position, in which the solenoids are turned off and are receiving no current. The upper end of the flap 18 defines an accept gate and engages a stop member 30 of the plate 14. The flap 20 rests against a stop member 32 of the plate 12 while the flap 22 rests against a stop member 34 between the plates 14 and 16. The flap 24 rests against a stop member 36 and the flap 28 rests against stop member 40. The solenoids or the flaps are provided with a spring biasing the flaps 18 through 28 to the rest position shown.

As shown, the flaps are arranged in three rows, wherein the first upper row lies in an accept plane in which the flap 18 shown in the rest position directs coins falling down in the direction of arrow 42 to a coin track 43 for rolling towards a return. The flaps 20 and 22 lie in a second row, their axes being located at the same height. The flaps 20, 22 are independently activated in response to the coin passing the photoelectric sensor A. The same applies with respect to the flaps 24, 28 defining the third, lower row.

Below the upper row are photoelectric sensors A and B. The photoelectric sensor A comprises an optical transmitter 44 and a receiver 46. The photoelectric sensor B is of similar design.

As may be noted, the flap 20 has a recess 50 located at the upper end and the longer flap 22 has an aperture 52 through which the light from the transmitter 44 can illuminate the receiver 46. Accordingly, the photoelectric sensor A can detect a coin passing the flaps 20, 22.

The flaps 24, 28 as well as the stop members 36, 40 are provided with apertures 54, 56, 58 and 60, respectively. Thus, a coin passing by the flaps 24, 28 may be detected by the photoelectric sensor B. The lower end of the classifying device 10 has five exits 62, 64, 68, 70, and 72 opening towards accept channels (not shown). A coin entering the apparatus in the direction of the arrow 42 can be thus directed to one of the exit openings 62 through 72 depending on the value of the coin and the position of the flaps 20 through 28.

The flaps 20, 22 are independently activated in response to the value signal of the coin tested. This value signal is produced in a coin testing device (not shown) which is arranged upstream of the classifying device 10. It should be understood that the flaps 18 through 28 will be activated one after the other. (This has some advantage with respect to the power required by the battery, also increasing the classifying speed, but is not necessarily required; after detecting the coin value the full coin path may be set at once.) The time period between actuating the flap 18 and actuating the flap 22 or 20 is 10 ms, for example. The time period until actuating the flaps 24, 28 amounts to a total of 50 ms. The entrance and exit of a coin into and out of the light beams of the photoelectric sensors A and B results in generating pulses for actuating the solenoids associated with the flaps arranged above. The solenoid for the flap 18 is deactivated when the coin is detected by the photoelectric sensor A. The solenoid for the flap 20 or 22 will be deactivated when the coin enters the beam of photoelectric sensor B. Accordingly, the flaps 18, 20, 22 remain in the operating position with their solenoids being deactivated as long as required for operating the classifying device. Return of the flap to the rest position can thus be initiated while the coin or a part thereof is still adjacent the respective flap. The pulse generated by the photoelectric sensor B can be further utilized for generating a credit signal. Finally, the time interval between the pulses generated by the photoelectric sensors A and B can be measured. When the measured time interval differs from a predetermined interval it is an indication of a fraudulent operation in trying to pull back a coin by means of a string. An erase signal will be produced which is used to eliminate the credit signal to block a product vending mechanism 31 from performing a vending operation.

Figure 2:
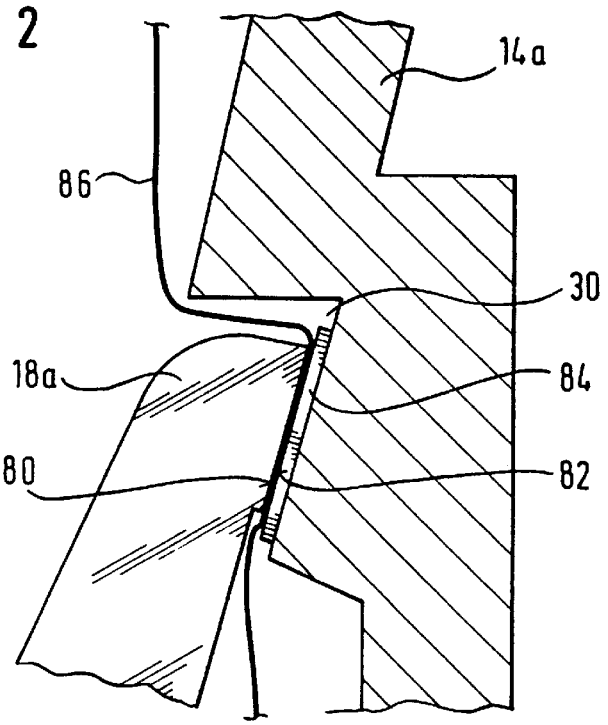
FIG. 2 is an enlarged fragmentary side view of the apparatus of FIG. 1 showing a flap engaging a string and a wall of a coin chute.

FIG. 1 illustrates coins 74, 76 in two different positions within the classifying device 10. Coin 74 is attached to a string suspended in a position below the photoelectric sensor B, and coin 76 hangs on a string adjacent the photoelectric sensor A. FIGS. 1 and 2 schematically illustrate how the string is manipulated by the apparatus of the present invention in the region of the flap 18. "String" as used herein may refer to string made of any suitable material, or to a wire. According to FIG. 2, the flap 18 includes an engaging front surface 80 at an upper end 18*a* thereof cooperating with an engaging surface 82 on a thin wafer 84 provided on the stop member 30. Preferably, the surface 82 is roughened to increase the frictional interaction with the string. When a string 86 enters in between the surfaces 80 and 82, the string will be squeezed by a predetermined force corresponding to the resetting force of the flap 18. Accordingly, passage of the string 82 between the surfaces 80, 82 will be resisted. A string attached to a relatively heavy coin will slow down, but the coin is still allowed to move further downwards as illustrated by coin 74 in FIG. 1. A string attached to a light coin may be stopped in the position of coin 76 shown in FIG. 1.

The processing and controlling device 79 (not shown) also measures the time the coin requires in passing the photoelectric sensors A and B. A coin (e.g. coin 74) attached to a string which has been squeezed by the flap will, of course, require a longer time to travel between photoelectric sensors A and B. When a predetermined time period is exceeded the signal will be initiated to indicate a coin attached to a string.

Figure 3:
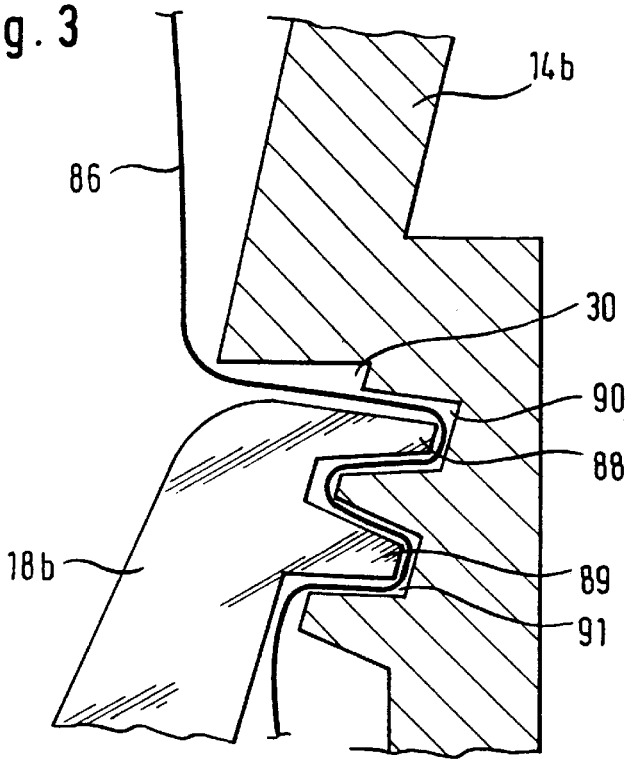
FIG. 3 is an enlarged fragmentary side view showing an alternate configuration of the flap and wall of FIG. 2.

An alternate configuration of the flap and stop member is shown in FIG. 3. The flap 18B (flap 18 in FIG. 1) comprises a pair of teeth 88, 89 engaging grooves 90, 91 defined between corresponding teeth on the stop member 30. Accordingly, a string 86 squeezed by the teeth 88, 89 into the recesses 90, 91 extends along a tortuous path. This results in a similar operation as described with reference to FIG. 2, where the travel of the string will be resisted resulting in a stoppage or a slowdown of the coin.

Figure 5:
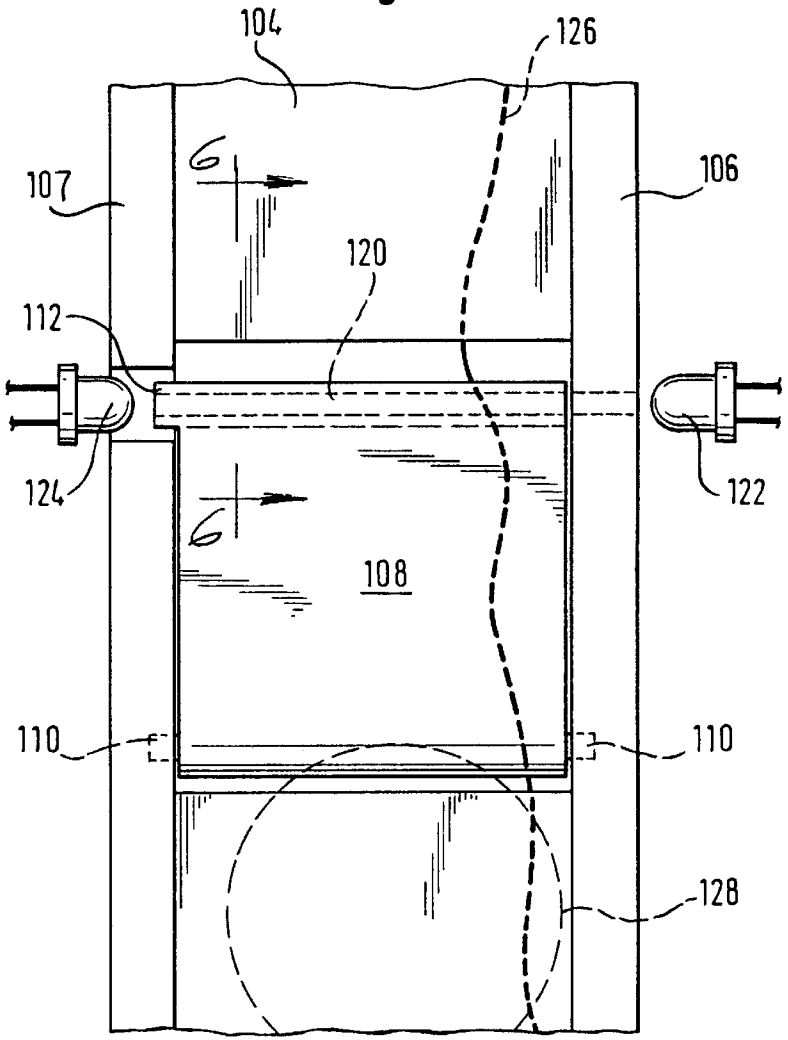
FIG. 5 is a front elevational view of the device of FIG. 4 seen in the direction of arrow 5.
Figure 4:
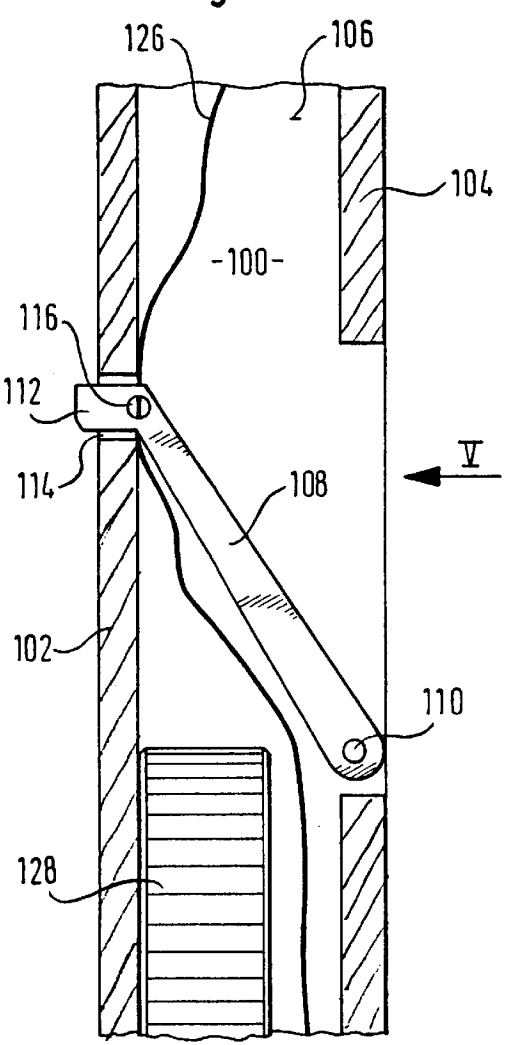
FIG. 4 is a side view of a portion of a coin-operated device according to a second embodiment of the invention.
Figure 6:
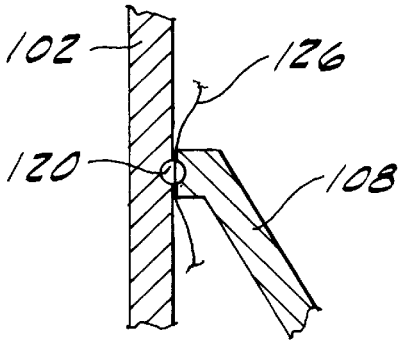
FIG. 6 is an enlarged fragmentary section taken in the plane including line 6—6 of FIG. 5.

FIG. 4 shows a coin chute 100 which is defined by side walls 102 and 104 as well as a further wall 106 and a wall 107 (not shown in FIG. 4) extending parallel with respect to the wall 106. The pivot 110 of a flap 108 is journalled at its ends in the wall 100 and the opposite wall. The flap extends towards the wall 102 when in the position shown in FIG. 4, with a single side lug 112 projecting into slot 114 in the wall 102. The upper edge of the flap 108 has a semi-circular groove in registration with one half of the hole 116 in the lug 112. In the position shown in FIG. 4, the other half of the hole 116 is in registration with an elongate, semi-circular groove in the wall 102. The groove in the wall 102, the groove in the flap 108 and the hole 116 cooperate to define a cylindrical optical channel 120 extending the full width of the chute (FIGS. 5 and 6). It should be understood that the cross-section of the optical channel 120 may be designed in a different way, for example, having a rectangular shape. The optical channel 120 defines a path for the light emanating from a light source 122. A photoelectrical receiver 124 is located at the opposite end. After a coin 128 to which a string 126 is attached has passed the flap 108 reaching a position indicated in FIG. 4, a control circuit (not shown) resets the flap 108 to the position shown in FIG. 4. The flap 108 can function as a so-called accept gate pivoting clockwise towards the righthand side when a credit signal is received in order to allow the coin to pass. FIG. 4 shows the gate 108 in the blocking position directing coins falling down into a reject channel. As soon as the gate 108 after passing a genuine coin returns to the blocking position shown in FIG. 4, the string 126 is generally loosely suspended in the chute 100 and is forced against the wall 102 by the flap 108 and into the optical channel 120. The string 126 extends generally through the center of the channel 120, causing a shadowing of the light path from the light source 122 which can easily be detected by the photoelectric receiver 124 in order to initiate a string signal.

When using a rather stiff or firm string (e.g., wire) there will not be full engagement of the wall 102, rather the upper edge of the flap 108 will come to rest in a certain distance from the wall 102. However, the lug 112 attached to the flap serves to prevent too much light from illuminating the receiver 124. Even in this case the presence of a string can be detected and signaled.

Figure 7:
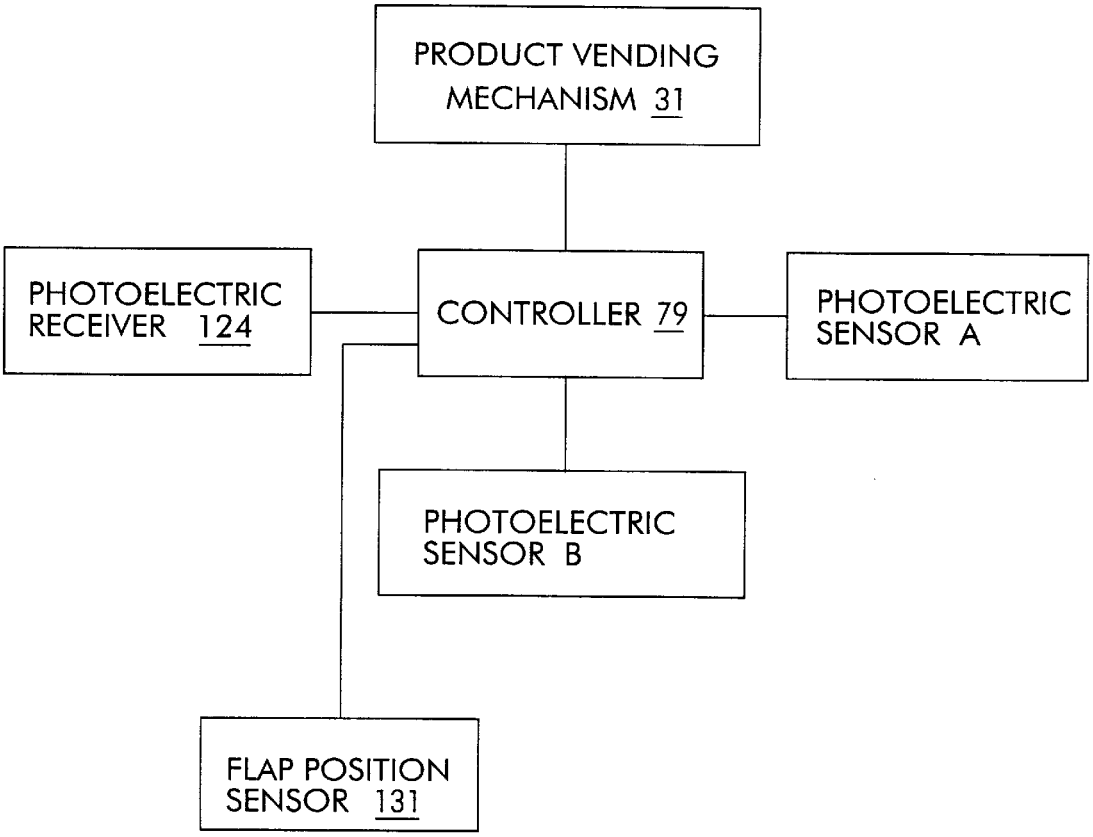
FIG. 7 is a block diagram of the apparatus of FIG. 1.

An additional sensor 131 may be included for determining a false position of the flap 108 (FIG. 7). A thicker string will not allow the flap 108 to completely return to the original position. The sensor 131 will determine if the flap 108 has not returned to its original position and transmit a signal to reduce the possibility of a fraudulent transaction.

Figure 6A:
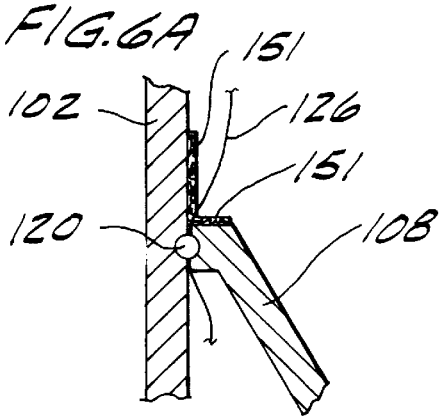
FIG. 6A is an enlarged fragmentary section as shown in FIG. 6 having material for preventing water from entering an optical channel.

In order to prevent malfunctions caused by water entering the optical channel 120, the flap 108 and the wall 102 may be provided with suitable draining means, for example, a fleece material 151 for absorbing moisture to keep liquid out of the optical channel 120 (FIG. 6A).

We claim:

1. Coin collection apparatus for use in a coin operated device to detect attempts at fraudulent transactions by use of a genuine coin suspended by a line for withdrawing the coin from the coin operated device after acceptance of the coin by the coin operated device and vending of the product or service, the coin operated device including a coin genuineness testing device, the coin collection apparatus comprising:

a chute having walls for receiving the genuine coin and directing the coin generally downward;

a flap disposed in the chute for blocking travel of the coin down the chute except past the flap;

an accept channel disposed generally downstream of the flap for receiving the genuine coin for passage to a coin collection receptacle of the coin operated device;

a reject channel disposed generally downstream of the flap for receiving a coin whose genuineness is rejected by the coin genuineness testing device;

the flap being pivotally mounted for swinging motion between an accept position in which the flap directs the coin whose genuineness is accepted by the coin genuineness testing device, and a reject position in which flap directs the coin whose genuineness has been rejected by the coin genuineness testing device, the flap and at least one of the chute walls being constructed and arranged to squeeze the line attached to the genuine coin between the flap and wall after passage of the genuine coin into the accept channel thereby to resist the further downward passage of the genuine coin in the accept channel;

a sensing device operable after passage of the genuine coin past the flap to detect the presence of the line being squeezed between the flap and the wall and generating a signal indicative of the presence of the line between the flap and wall, the sensing device being disposed for detecting the passage of the genuine coin past selected locations in the accept channel downstream of the flap, one of said locations being located generally upstream of the other of said locations in the accept channel, the sensing device being capable of generating a signal upon passage of the genuine coin past each of said locations;

a controller for receiving the signal from the sensing device and generating a signal of a fraudulent transaction occurrence to be used for controlling the coin operated device, the controller being configured to determine a time interval between passage of the genuine coin past said one location and said other location, to compare the determined time interval with a preset maximum time interval and to generate a fraudulent transaction signal if the determined time interval exceeds the predetermined maximum time interval thereby indicating the presence of the line connected to the genuine coin between the flap and the wall of the chute, the controller being further configured for returning the flap from the accept position to the reject position upon passage of the genuine coin past the flap and into the accept channel;

the flap and wall being formed to cooperate in the reject position of the flap to define an optical channel extending transversely of the chute, the line being forced into the optical channel by the flap moving to the reject position from the accept position;

the sensing device further comprising a photoelectric sensor disposed for viewing through the optical channel to detect the presence of a shadow cast by the line in the channel and generating a signal to the controller indicative of the presence of the line in the channel.

2. Coin collection apparatus as set forth in claim 1 wherein at least one of the flap and the chute wall is provided with an increased friction surface engageable with the line to resist movement of the line over the surface.

3. Coin collection apparatus as set forth in claim 1 wherein the flap and the chute wall are formed with teeth adapted for intermeshing to bite the line in the reject position of the flap.

4. Coin collection apparatus as set forth in claim 1 wherein the sensing device further comprises a sensor for detecting whether the flap has fully returned to the reject position and generating a signal to the controller indicating that the flap is blocked from fully returning to the reject position.

5. Coin collection apparatus as set forth in claim 1 further comprising means for preventing a liquid from entering the optical channel.

6. Coin collection apparatus as set forth in claim 1 wherein the photoelectric sensor comprises a light source and a photoelectric light receiver disposed generally on opposite ends of the optical channel, and wherein the flap comprises means for shielding the light receiver from additional light when the flap is unable to fully return to the reject position.

7. Coin collection apparatus as set forth in claim 6 wherein said shielding means comprises a lug associated with the flap and a slot in the chute wall, the lug being received in the slot when the flap is spaced from the reject position thereby to shield the light receiver from additional light caused by light entering the optical channel from the chute.

8. Coin collection apparatus for use in a coin operated device to detect attempts at fraudulent transactions by use of a genuine coin suspended by a line for withdrawing the coin from the coin operated device after acceptance of the coin by the coin operated device and vending of the product or service, the coin operated device including a coin genuineness testing device, the coin collection apparatus comprising:

a chute having walls for receiving the genuine coin and directing the coin generally downward;

a flap disposed in the chute for blocking travel of the coin down the chute except past the flap;

an accept channel disposed generally downstream of the flap for receiving the genuine coin for passage to a coin collection receptacle of the coin operated device;

a reject channel disposed generally downstream of the flap for receiving a coin whose genuineness is rejected by the coin genuineness testing device;

the flap being pivotally mounted for swinging motion between an accept position in which the flap directs the coin whose genuineness is accepted by the coin genuineness testing device, and a reject position in which flap directs the coin whose genuineness has been rejected by the coin genuineness testing device, the flap and at least one of the chute walls being constructed and arranged to squeeze the line attached to the genuine coin between the flap and wall after passage of the genuine coin into the accept channel;

the flap and wall being formed to cooperate in the reject position of the flap to define an optical channel extending transversely of the chute, the line being forced into the optical channel by the flap moving to the reject position from the accept position;

a sensing device operable after passage of the genuine coin past the flap to detect the presence of the line being squeezed between the flap and the wall and generating a signal indicative of the presence of the line between the flap and wall, the sensing device comprising a photoelectric sensor disposed for viewing through the optical channel to detect the presence of a shadow cast by the line in the channel and generating a signal indicative of the presence of the line in the channel;

a controller for receiving the signal from the sensing device and generating a signal of a fraudulent transaction occurrence to be used for controlling the coin operated device.

9. Coin collection apparatus as set forth in claim 8 wherein the flap and wall are formed to cooperate in the reject position of the flap to define an optical channel extending transversely of the chute, the line being forced into the optical channel by the flap moving to the reject position from the accept position, and wherein the sensing device further comprises a photoelectric sensor disposed for viewing through the optical channel to detect the presence of a shadow cast by the line in the channel and generating a signal to the controller indicative of the presence of the line in the channel.

10. Coin collection apparatus as set forth in claim 9 wherein the wall has a groove therein extending transversely of the chute and an upper end of the flap has a corresponding groove therein extending transversely of the chute, the wall groove and the flap groove defining the optical channel in the reject position of the flap.

11. Coin collection apparatus as set forth in claim 10 wherein the photoelectric sensor comprises a light source and a photoelectric light receiver disposed generally on opposite ends of the optical channel, and wherein the flap comprises means for shielding the light receiver from additional light when the flap is unable to fully return to the reject position.

12. Coin collection apparatus as set forth in claim 11 wherein said shielding means comprises a lug associated with the flap and a slot in the chute wall, the lug being received in the slot when the flap is spaced from the reject position thereby to shield the light receiver from additional light caused by light entering the optical channel from the chute.

13. Coin collection apparatus as set forth in claim 12 wherein the sensing device further comprises a sensor for detecting whether the flap has fully returned to the reject position and generating a signal to the controller indicating that the flap is blocked from fully returning to the reject position.

14. Coin collection apparatus as set forth in claim 8 wherein the sensing device is disposed for detecting the passage of the genuine coin past selected locations in the accept channel downstream of the flap, one of said locations being located generally upstream of the other of said locations in the accept channel, the sensing device being capable of generating a signal upon passage of the genuine coin past each of said locations;

the controller being configured to determine a time interval between passage of the genuine coin past said one location and said other location, to compare the determined time interval with a preset maximum time interval and to generate a fraudulent transaction signal if the determined time interval exceeds the predetermined maximum time interval thereby indicating the presence of the line connected to the genuine coin between the flap and the wall of the chute.

15. Coin collection apparatus as set forth in claim 14 wherein at least one of the flap and the chute wall is provided with an increased friction surface engageable with the line to resist movement of the line over the surface.

16. Coin collection apparatus as set forth in claim 14 wherein the flap and the chute wall are formed with teeth adapted for intermeshing to bite the line in the reject position of the flap.

17. Coin collection apparatus as set forth in claim 8 wherein the controller is configured for returning the flap from the accept position to the reject position upon passage of the genuine coin past the flap and into the accept channel.

18. Coin collection apparatus as set forth in claim 8 further comprising means for preventing a liquid from entering the optical channel.

* * * * *